United States Patent [19]

Black

[11] Patent Number: 4,505,079

[45] Date of Patent: Mar. 19, 1985

[54] THERMAL WINDOW SHIELD

[76] Inventor: Ervin H. Black, 1415 Wenonah Ave., Berwyn, Ill. 60402

[21] Appl. No.: 387,044

[22] Filed: Jun. 10, 1982

[51] Int. Cl.[3] ..... E06B 1/04

[52] U.S. Cl. ..... 52/202; 52/213

[58] Field of Search ..... 52/202, 203, 475, 213; 49/62, 463; 160/354, 368 R

[56] References Cited

U.S. PATENT DOCUMENTS

| | | | |
|---|---|---|---|
| 1,961,584 | 6/1934 | Hathorn | 49/463 |
| 2,381,129 | 8/1945 | Lind | 52/211 |
| 2,627,951 | 2/1953 | Mitchell | 49/463 |
| 3,636,661 | 1/1972 | Srawsine | 49/463 |
| 3,745,704 | 7/1973 | Covington | 49/463 |
| 4,069,641 | 1/1978 | DeZutter | 52/202 |
| 4,121,379 | 10/1978 | Everson | 52/202 |
| 4,160,348 | 7/1979 | Chapman et al. | 52/202 |
| 4,182,088 | 1/1980 | Ball | 52/202 |
| 4,193,235 | 3/1980 | Cucchiara | 52/202 |
| 4,215,517 | 8/1980 | Everson | 52/202 |
| 4,271,566 | 6/1981 | Perina | 52/202 |
| 4,272,931 | 6/1981 | Stanizzo | 52/211 |

FOREIGN PATENT DOCUMENTS

| | | | |
|---|---|---|---|
| 533125 | 11/1954 | France | 52/202 |

*Primary Examiner*—Carl D. Friedman

*Attorney, Agent, or Firm*—Balogh, Osann, Kramer, Dvorak, Genova & Traub

[57] ABSTRACT

A thermal window shield has been designed for reducing heat losses in window structures made from metal, and particularly useful for thermally shielding Jalousie windows. The thermal window shield has a thermal frame made from poor transmitting material, and secured to the metal window frame by appropriate means. For example, the thermal frame may be secured to the metal window frame by adhesive or by a foam tape. In lieu of the foam tape, the thermal frame may be provided with spacing means in the form of protuberances which establish a space between the thermal frame and the metal frame to thereby provide a thermal air barrier. The thermal frame supports a thermal pane which is slidably and removably secured so that it can be readily removed for venting purposes when the Jalousie window is opened.

1 Claim, 14 Drawing Figures

FIG. 1
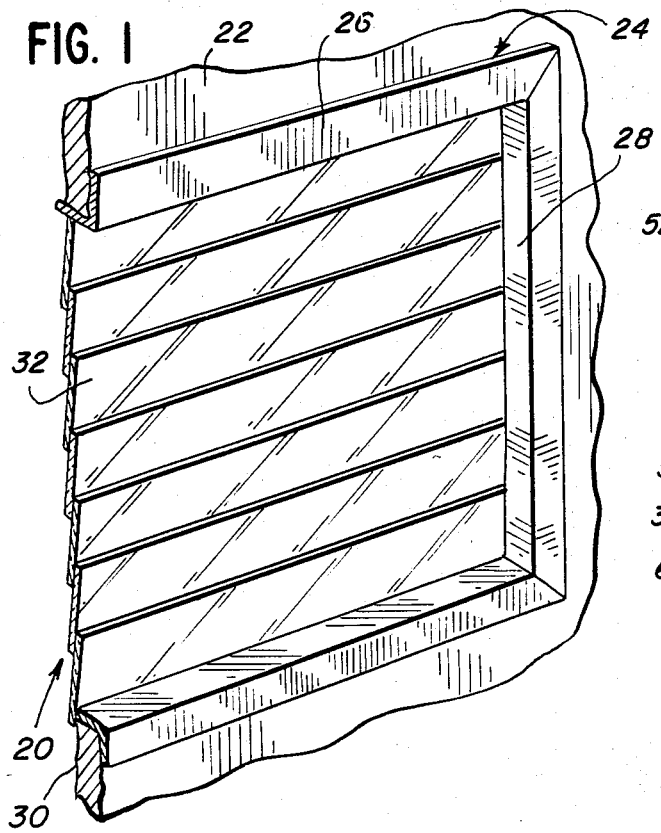
FIG. 2
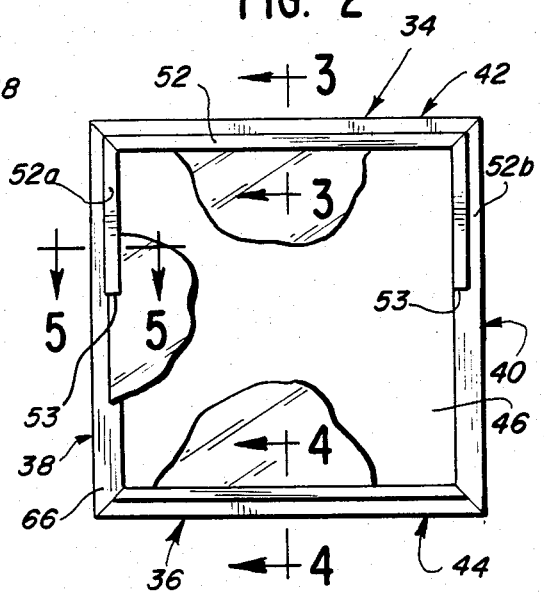
FIG. 5
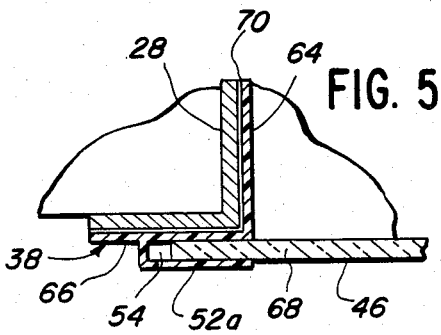
FIG. 3
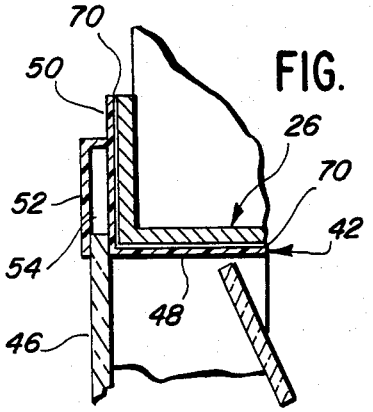
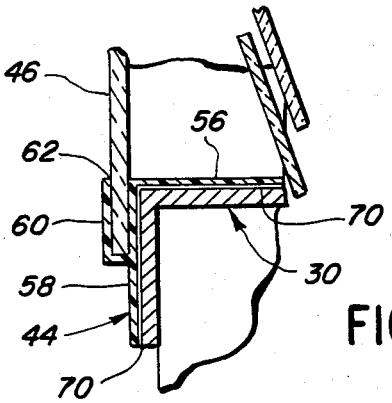
FIG. 4
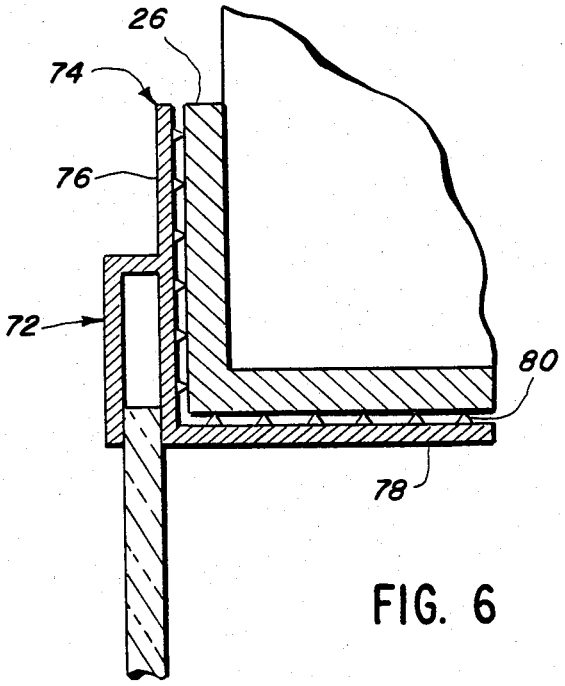
FIG. 6

FIG. 10
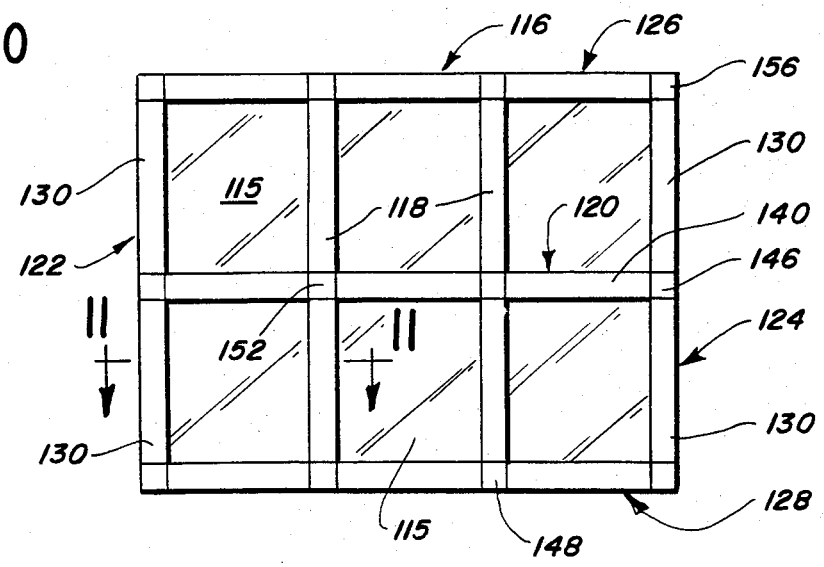
FIG. 11
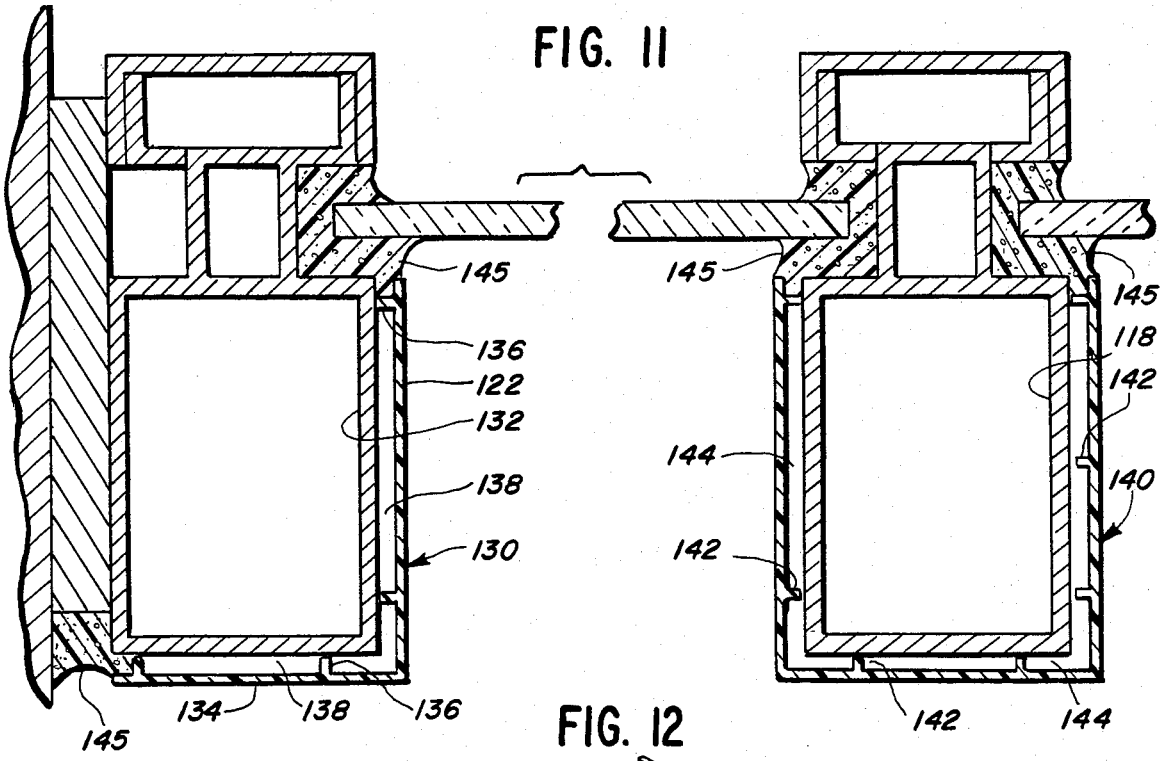
FIG. 12
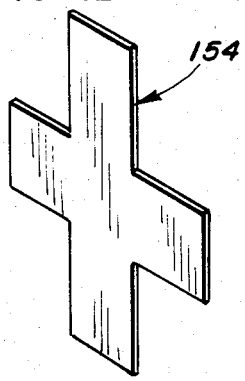
FIG. 13
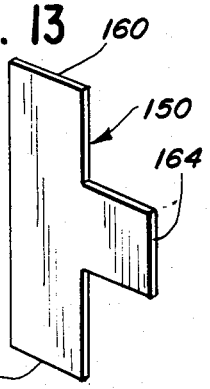
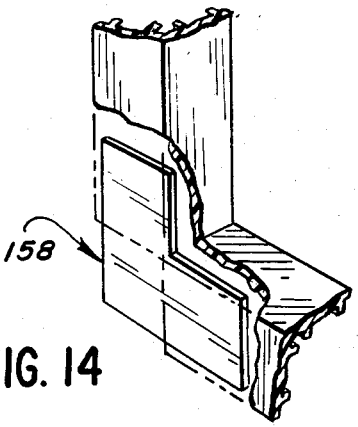
FIG. 14

THERMAL WINDOW SHIELD

BACKGROUND OF THE INVENTION

1. Field of the Invention

This invention relates generally to window structures and, more particularly, to a protective shield covering the window structure to provide a thermal barrier.

2. Description of the Prior Art

Modern glass window structures are usually made with an extruded metal frame, usually of aluminum, which supports a glass unit such as a window pane or a Jalousie window, at its perimeter, and lends strength and rigidity thereto. When used in situations where there is a large difference in temperature at opposing sides of the window structure, such as a Jalousie window mounted in a wall of a bathroom and subjected to an outside freezing temperature, the glass portion of the window and the supporting metal frame conduct an excessive amount of heat from the warm interior of the room to the outside freezing temperature. Furthermore, there is a tendency for the moisture inside the room to condense and freeze on the inner surfaces of the window and on the metal frame.

Many approaches have been made for solving this problem with various designs of storm windows. For example, U.S. Pat. No. 2,191,500 describes an arrangement for adding an additional window pane which is supported by frame members mounted by screws to the window frame. This type of securement makes it difficult for the window pane to be removed for cleaning purposes or for permitting airing between the interior of the house and the outside.

Another form of a storm window is described in U.S. Pat. No. 4,121,379 wherein an additional window pane, peripherally supported by a frame, is attachable on the inside of a regular window by means of a plurality of turn locks. This type of securement also requires some effort for removal of the additional window pane.

A still further arrangement for a storm window is disclosed in U.S. Pat. No. 4,069,641 wherein a tape frame is mounted on the inside of the periphery of the regular window, the tape frame being provided with means for securing a glazing frame so that an additional window pane may be secured between the tape frame and the glazing frame. Again this requires considerable effort to remove the additional window pane whenever it is so desired.

SUMMARY OF THE INVENTION

To overcome the foregoing disadvantages, the present invention comprises a thermal window shield having a thermal frame adapted to be secured on the inside of a metal frame of a window structure and supporting a thermal pane which can be readily removed.

The thermal frame has a pair of vertical frame members connected by a pair of horizontal frame members which have channels for supporting the thermal pane. The channel in the upper frame member is deeper than the channel in the bottom frame member so that during the insertion of the thermal pane into the channel in the upper frame member, the thermal pane can be slid upwardly before it is permitted to slide downwardly into the channel in the lower frame member. The vertical sides of the thermal pane intimately abut the sides of the vertical frame members.

The thermal window shield is made from a thermally insulating material such as a plastic. The surfaces of the thermal frame which are to be secured to the metal window frame are lined with spacing means such as foam tape which, after a protective strip is removed, the foam tape adheres to the metal window frame. As an alternative, the surfaces of the thermal frame abutting the metal window frame can be provided with protuberance in the form of a plurality of ribs or nibs for spacing the thermal frame from the metal window frame, the ribs or nibs being provided with an adhesive for securing the thermal frame to the metal window frame.

In another form of a thermal frame, the frame is provided with spacing means in the form of a single spacer rib which is instrumental in providing air chambers between the surfaces of the metal window frame and the interior surfaces of the thermal frame. These air chambers serve as insulating thermal barriers. In the event that the window arrangement has a number of double-pane windows spaced by means of mullions and transom members, means are provided for covering the surfaces of such metal mullions and transom members with a cladding made from thermal insulating material such as plastic. The intersecting joints between the mullions, the transom members, and the exterior metal frame of the window arrangement are covered by thermally insulating flap members sealingly attached with the transom members, the mullions and the frame members and the cladding.

One of the objects of the invention is to provide a thermal window shield having a readily removable thermal pane.

Another object of the invention is to provide a thermal window shield having a thermal frame made of material, such as plastic, for thermally insulating the metal window frame and supporting a removable transparent thermal pane to thereby provide a protective thermal barrier over the window structure to prevent heat loss.

A still further object of the invention is to provide a thermal frame having surfaces provided with thermal insulating means such as foam tape or spacing members which are adapted to adhere to the metal surfaces of the metal window frame.

A still further object of the invention is to provide a thermal frame having a spacing rib designed to establish entrapped air chambers between the thermal frame and the metal window frame, and further supporting a thermal pane at a predetermined distance from the metal window frame.

Another object of the invention is to provide a cladding provided with means for securement to the metal window frame, the securement means providing a number of air chambers effectively providing thermal barriers.

Also, the invention provides cladding for the metal portions of a complex window structure having a plurality of double pane windows interconnected by mullions and transom members, adapted to thermally shield the frame structure, the mullions and the transom members.

A further object of the invention is to provide thermal barriers at junctions existing between the mullions and the transom members, the mullions and the window frame members and the transom members and the window frame members.

Other characteristics, advantages and objects of this invention can be more readily appreciated from the following description and appended claims.

DESCRIPTION OF THE DRAWINGS

Referring more particularly to the accompanying drawings, which are for illustrative purposes only:

FIG. 1 is a partial perspective view of a Jalousie window which could be thermally shielded by the present invention;

FIG. 2 is a view in front elevation of a thermal window shield;

FIG. 3 is an enlarged sectional view taken along the lines 3—3 in FIG. 2;

FIG. 4 is an enlarged sectional view taken along the lines 3—3 in FIG. 2;

FIG. 5 is an enlarged sectional view taken along the lines 5—5 in, FIG. 2;

FIG. 6 is an enlarged sectional view of another embodiment of a thermal window shield which uses integrally formed spacer members for spacing a thermal frame from a metal window frame;

FIG. 10 is a view in front elevation of a complex window arrangement having a plurality of double-pane windows intersected by mullions and transom members;

FIG. 11 is an enlarbed sectional view taken along the lines 11—11 in FIG. 10;

FIG. 12 a perspective view of a flap designed to thermally cover the junctions existing between the mullions and the transom members;

FIG. 13 is a perspective view of a flap designed to thermally cover the junctions existing between the transom members and the peripheral window frame members and the junctions existing between the mullions and the peripheral window frame members; and FIG. 14 is a perspective view of a flap for thermally covering the junctions existing at the intersections of the horizontal and vertical window frame members.

DESCRIPTION OF THE PREFERRED EMBODIMENT

Figure 7:
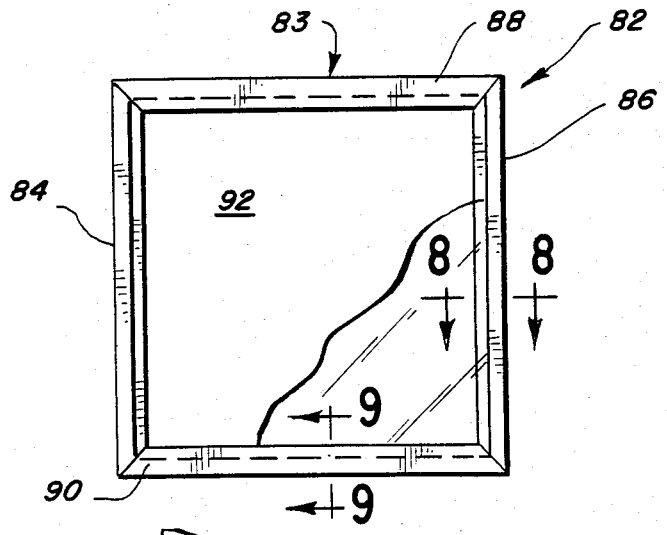
FIG. 7 is a view in front elevation of another embodiment of a thermal window shield.

This invention is primarily concerned with reducing heat loss through conduction through a Jalousie window structure having a series of louvered window pane slats which can be opened mechanically to provide communication between the air in a room and the outside atmosphere. However, it should be pointed out that this invention can also be used with any window structure made of metal which causes heat losses through conduction.

Referring to FIG. 1, there is shown a Jalousie window structure 20 mounted in a wall 22. The window structure 20 comprises a metal frame 24 having a header member 26, a jamb 28 (only one shown for clarification purposes), and a sill member 30. A series of window pane slats 32 are supported within the metal frame 24.

To reduce heat losses occurring in the Jalousie window structure 20, a thermal window shield 34, as shown in FIG. 2, has been designed to cover the metal surfaces of the window structure 20 and to cover the opening defined by the metal frame 24.

The thermal window shield 34 comprises a thermal frame 36 constructed of a pair of vertical frame members 38 and 40 interconnected by a pair of horizontal frame members 42 and 44, and a thermal pane 46 supported by the foregoing frame members. As best viewed in FIG. 2, the channel wall 52 extends completely across the frame member 42 and communicates with channel walls 52*a* and 52*b* extending downwardly along the vertical frame members 38 and 40, respectively. The channel walls 52*a* and 52*b* extend downwardly about fifty percent (50%) of the length of the frame members 38 and 40. The channel walls 52*a* and 52*b* provide lateral support for the thermal pane 46 as it is inserted at points 53 into the channel 54 which has a U-shape, the light being defined by the frame member 42 and interconnecting two arms defined by the channel walls 52*a* and 52*b*. This arrangement prevents the thermal pane 46 from bowing in either direction because of temperature differential existing across the thickness of the thermal pane.

Referring to FIG. 3, the frame member 42 has an interior wall 48 disposed at a 90° angle to an exterior wall 50 which supports a channel wall 52 which, in conjunction with the exterior wall 50, defines a channel 54 for admitting the thermal pane 46.

The frame member 44, as shown in FIG. 4, has an interior wall 56 interconnecting at a right angle with an exterior wall 58 which supports a channel wall 60 which, in conjunction with the exterior wall 58, defines a channel 62 for supporting the bottom of the thermal pane 46.

At this point, it should be pointed out that the depth of the channel 54 in the upper frame member 42 is greater than the depth of the channel 62 in the lower frame member 44 so that the thermal pane 46 can be inserted first into the channel 54 and then dropped into the channel 62. The channels 54 and 62 comprise the means for slidably and removably securing the thermal pane on said thermal frame.

The construction of the vertical frame members 38 and 40 is the same and, therefore, only a sectional view, as shown in FIG. 5, will be concerned with the frame member 38. The frame member 38 has an interior wall 64 interconnected at a right angle with an exterior wall 66 which supports the channel wall 52*a*, which in conjunction with the exterior wall 66, defines the channel 54. It is apparent that when the thermal pane 46 is supported within the channels 54 and 62, vertical sides 68 of the thermal pane 46 abut the external walls 66. The thermal frame 36 is secured to the metal frame 24 by a foam tape 70. For example, referring to FIG. 3, the foam tape 70 heat-insulatingly spaces both the exterior wall 50 and the interior wall 48 from the header member 26. Similarly, the foam tape 70, as shown in FIG. 4, thermally insulates the exterior wall 58 and the interior wall 56 from the sill member 30. In a similar manner, the vertical frame members 38 and 40 are thermally insulated from the jambs 28, this being particularly shown in FIG. 5 wherein the foam tape 70 thermally insulates the interior wall 64 and the exterior wall 66 from the jamb 28.

As best viewed in FIG. 2, the frame members 38, 40, 42 and 44 comprise four extruded pieces made from plastic material, mitered together and then secured by appropriate means such as adhesive or electronic welding. Another way of fabricating the thermal frame 36 would be by molding, for example, frame members 38, 40 and 44 in an integral unit in a mold and extruding the frame members 42 which would then be secured to the integral unit. The frame members can be made from polyvinyl chloride, polyprophylene, ABS or other suitable semiflexible plastics. The thermal pane 46 is made from hard acrylic transparent plastic or other suitable transparent plastic. It is contemplated that the entire thermal frame 36 can be molded as an integral unit made from soft resilient plastic so that the unit can be stripped out of the mold.

Although the thermal pane receiving channels are contained in the upper and lower horizontal frame members, it is obvious that the channels could be disposed in the vertical frame members. In either situation, the thermal pane is slidably and removably secured on the thermal frame so that during warm weather, the thermal pane can be removed and the louvered window slats 32 can be opened.

An alternative manner of thermally insulating the thermal frame from the metal window frame 24 is shown in a sectional view in FIG. 6 wherein a modified thermal frame 72 is constructed of a frame member 74 identical to the construction shown in FIG. 2 except that, in the modified version, the frame member 74 has an exterior wall 76 and an interior wall 78 provided with spacing means 80 such as nibs or ribs which establish air chambers between the exterior and interior walls 76, 78 and the header member 26. The sectional view shown in FIG. 6 generally corresponds to the sectional view shown in FIG. 3. If similar sectional views were taken of the modified thermal frame 72 as was done for the thermal frame 36 shown in FIG. 2, these similar sectional views would be similar to the sectional views in FIGS. 4 and 5, except that the foam tape 70 would be replaced by the spacing means 80.

The nibs 80 may be integrally formed with the thermal frame members such as frame member 78 or the nibs may be secured to the frame member with an adhesive. It is preferred that the nibs exhibit resiliency so that the thermal frame 72 may be pushed into the opening defined by the metal frame 24.

Figure 8:
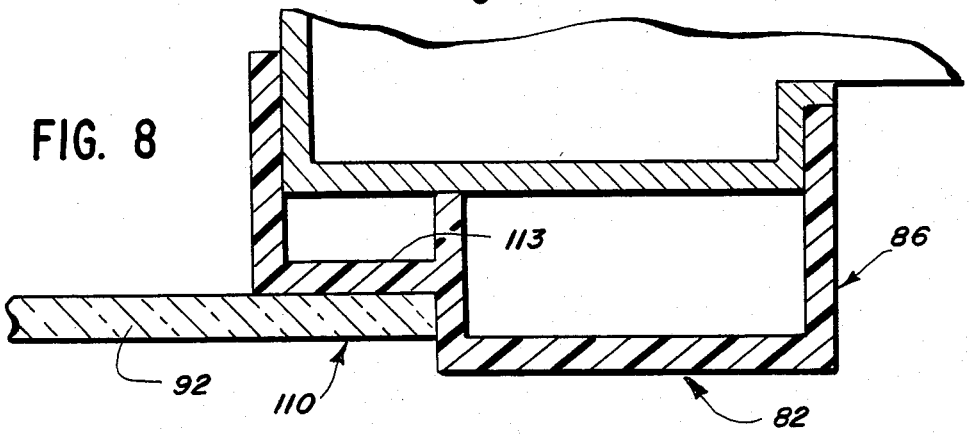
FIG. 8 is an enlarged sectional view taken along the lines 8—8 in FIG. 7.
Figure 9:
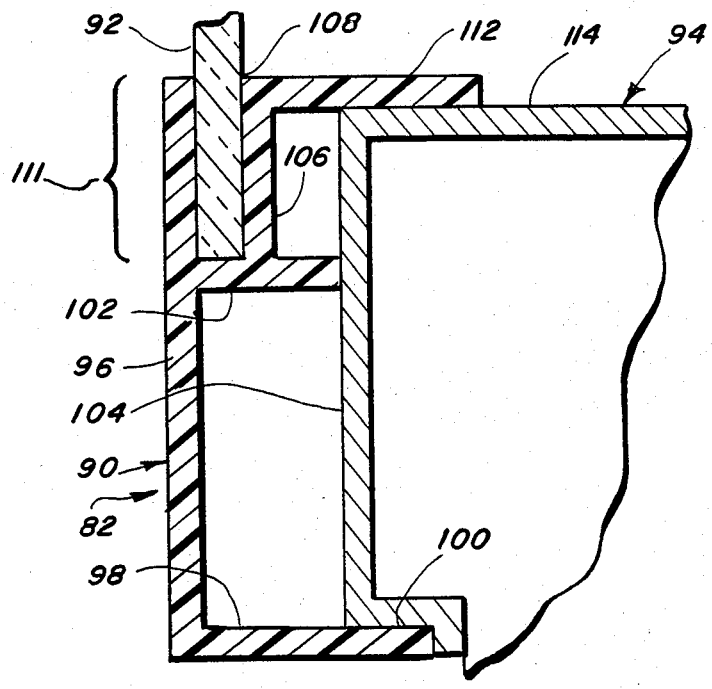
FIG. 9 is an enlarged sectional view taken along the lines 9—9 in FIG. 7.

Another form of a modified thermal window shield is illustrated in FIGS. 7–9 wherein a thermal window shield 82 comprises a thermal frame 83 having a pair of vertical frame members 84 and 86 interconnected by a pair of horizontal frame members 88 and 90 and supporting a thermal pane 92. This modified thermal frame 83 uses a different form of spacing means to establish an insulating air chamber between the thermal frame 83 and the metal window frame. Referring particularly to FIG. 9, there is shown a sill member 94 which is a portion of a metal window structure (not shown). The horizontal frame member 90 comprises a planar wall 96 provided with a flange wall 98 extending at right angles to the wall 96 and abutting a shoulder 100 on the sill member 94. Extending from the planar wall 96 and spaced from the outer flange wall 98 is spacing means 102 in the form of a rib having the main function of spacing the planar wall 96 from a surface 104 of the sill member 94. Extending from a median portion of the spacing means 102 is a channel wall 106 which, in conjunction with a portion of the planar wall 96, defines a channel 108 for admitting a thermal pane 92. Extending from the free end of the channel wall 106, at right angle thereto, is an inner flange wall 112 which is adapted to engage a surface 114 on the sill member 94.

If a sectional view were taken of the upper horizontal frame member 88, the sectional view would be similar to that shown in FIG. 9, with the exception that the channel in the upper frame member 88 would be deeper than the channel 108 in the lower frame member 90. As previously explained in conjunction with the description of the thermal frame 36 in FIGS. 1–5, the upper channel is deeper than the lower channel so that the thermal pane can be readily inserted into the upper channel and then dropped into the lower channel.

In extruding the vertical frame members 84 and 86, they would have generally the same cross-sectional construction as the horizontal frame members 88 and 90. This is apparent when comparing the sectional view of the vertical frame members 86, as shown in FIG. 8, and the sectional view of the horizontal frame member 90, as shown in FIG. 9. The mold used for extruding the vertical frame member 86 extrudes an open-faced channel 110 as opposed to a close-faced channel 108 shown in FIG. 9. In other words, a portion 111 of the planar wall 96 in FIG. 9 is not present in the frame member 86 shown in FIG. 8. The thermal pane 92 abuts an open-faced channel wall 113.

The improvement of the present invention, as achieved with the use of spacing means to develop a thermal barrier in the form of air chambers between the thermal window shield and the metal frame of a window structure, can be further extended to complex window structures provided with a plurality of double-pane windows which do not require the use of a thermal pane such as 46. Referring to FIG. 10, there is shown an illustration of a complex window structure having a plurality of double-pane windows 115 supported in a frame structure 116 including mullions 118 and transom members 120. The frame structure 116 also includes a pair of vertical members 122 and 124 interconnected by a pair of horizontal frame members 126 and 128. Since the frame structure 116 including the mullions 118 and the transom members 120 is made of metal, the efficiency of the double-pane window construction is reduced by the loss of heat conducted through the metal portions of the window frame structure. To improve the efficiency of such a type of a window structure, a cladding is provided for covering the metal portions of the window metal frame structure, thereby providing a thermal barrier.

Referring particularly to FIG. 11, the vertical frame member 122 is covered by an L-shaped cladding member 130 having an inset wall 132 connected at right angles to an outset wall 134. The interior surfaces of the inset and outset walls 132 and 134 are provided with a plurality of spacing means 136 which may be in any form of protuberances such as nibs, ribs or fins. The purpose of the spacing means 136 is to provide air chambers 138 between the cladding member 130 and the vertical frame member 122.

In order to cover the surfaces of the mullion 118, a U-shaped cladding member 140 is used. This cladding member 140 is similarly provided with spacing means 142 which establishes air chambers 144 which act as thermal barriers to transmission of heat. The free ends of the cladding members 130 and 140 are sealed with calking material 145.

Referring to FIG. 10, it will be noted that the junctions between the mullions 118, the transom members 140 and the frame members 122, 124, 126 and 128 are covered by cladding members having different shapes as illustrated in FIGS. 12–14. For example, in order to provide a thermal barrier at a junction 146 existing between the transom 120 and the vertical frame member 124 or a junction 148 existing between the mullion 118 and the horizontal frame member 128, a T-shaped cladding member 150 would be used, as shown in FIG. 13.

To provide a protective thermal barrier at a junction 152 existing between a mullion 118 and the transom member 120, an X-cladding member 154, as shown in FIG. 12, would be used. As for the junctions established between the two horizontal frame members 126 and 128 with the two vertical frame members 122 and 124, as particularly identified by a junction 156, an L-shaped cladding member 158 would be used.

It is preferred that the cladding members shown in FIGS. 12–14 be installed first on the frame structure 116 prior to the installation of the other cladding members covering the vertical and horizontal frame members, the transom members and the mullions. For example, the junction 146 existing between the vertical frame member 124 and the transom member 120 would be initially covered with the T-cladding device 150 by means of an adhesive. Thereafter, end portions 160 and 162 would be overlapped or covered by the L-shaped cladding members 130 and end portion 164 would be overlapped by the U-shaped cladding member 140 positioned over the transom member 140. In a similar manner, the junctions 156 and 152 would be appropriately covered with cladding members 158 and 154, respectively. In the alternative, the various junctions existing in the frame structure 116 could be covered after the various L-shaped cladding members and U-shaped cladding members have been installed.

The cladding devices 150, 154 and 158 can also be provided with spacing members which would space them away from the metal frame structure 116 and thereby provide a thermal air barrier. In the event the cladding devices are secured on top of the cladding members 130 and 140, there is no need for any spacing members because the thickness of the cladding members 130 and 140 space the cladding devices 150, 154 and 158 from the metal frame structure.

The illustrations in FIGS. 10 and 11 have been described as being concerned with a double-pane window construction which would not require the use of a thermal pane. In the event that the window structure uses a single-pane construction, it is possible to mold the cladding members 130 and 140 to possess flanges which would define support surfaces for supporting the thermal pane. In other words, each of the window openings in the window structure 116 would receive a thermal pane supported by flanges on the cladding members framing each window opening.

The invention and its attendant advantages will be understood from the foregoing description, and it will be apparent that various changes may be made in the form, construction and arrangement of the parts of the invention without departing from the spirit and scope thereof or sacrificing its material advantages, the arrangement hereinbefore described being merely by way of an example, and there is no intention to be restricted to the specific form shown or uses mentioned, except as defined in the appended claims.

What is claimed is:

1. A Thermal window shield adapted to be fitted over a Jalousie window frame provided with metal interior and exterior facing walls defining a window opening, comprising a thermal frame made from poor heat transmission material, said thermal frame having pairs of vertically and horizontally extending interior and exterior facing walls to substantially and complementarily clad said metal interior and exterior walls, means for heat insulatingly securing each thermal frame to said metal interior and exterior facing walls, a thermal pane made from poor heat transmission material, a pair of deep channel forming members extending downwardly about 50% along the length of said vertically extending exterior facing walls, a further deep channel forming member extending completely across the width of upper horizontally extending exterior facing wall and communicating with said pair of channel forming members, and a shallow channel forming member extending completely across the width of lower horizontally extending exterior facing wall, all of said channel forming members cooperating to receive and removably support said thermal pane, whereby said deep channel forming members cooperate to prevent said thermal pane from bowing in either direction because of temperature differential existing across the thickness of said thermal pane.

* * * * *